US007878251B2

(12) United States Patent
Giacomino et al.

(10) Patent No.: US 7,878,251 B2
(45) Date of Patent: Feb. 1, 2011

(54) MULTIPLE STAGE TOOL FOR USE WITH PLUNGER LIFT

(75) Inventors: Jeffrey L. Giacomino, Brighton, CO (US); Paul T. Roberts, Firestone, CO (US)

(73) Assignee: Production Control Services, Inc., Frederick, CO (US)

( * ) Notice: Subject to any disclaimer, the term of this patent is extended or adjusted under 35 U.S.C. 154(b) by 271 days.

(21) Appl. No.: 12/051,684

(22) Filed: Mar. 19, 2008

(65) Prior Publication Data

US 2008/0230230 A1 Sep. 25, 2008

Related U.S. Application Data

(60) Provisional application No. 60/895,692, filed on Mar. 19, 2007.

(51) Int. Cl.
*E21B 43/00* (2006.01)

(52) U.S. Cl. ..... 166/372; 417/56

(58) Field of Classification Search ..... 166/68, 166/105, 372; 417/56–60
See application file for complete search history.

(56) References Cited

U.S. PATENT DOCUMENTS

| | | | | |
|---|---|---|---|---|
| 1,495,807 | A | 5/1924 | Sanders | |
| 2,676,547 | A * | 4/1954 | Knox | 417/60 |
| 3,179,022 | A | 4/1965 | Bloudoff | |
| 4,528,896 | A | 7/1985 | Edwards | |
| 5,431,229 | A | 7/1995 | Christensen | |
| 6,325,152 | B1 | 12/2001 | Kelley et al. | |
| 6,568,477 | B1 | 5/2003 | Dveyrin | |
| 6,907,926 | B2 | 6/2005 | Bosley | |
| 7,080,691 | B1 | 7/2006 | Kegin | |
| 7,080,692 | B1 | 7/2006 | Kegin | |
| 7,191,838 | B2 | 3/2007 | Reitz | |
| 7,404,446 | B2 * | 7/2008 | Du et al. | 166/386 |

* cited by examiner

*Primary Examiner*—Daniel P Stephenson
(74) *Attorney, Agent, or Firm*—A Law Firm, P.C.

(57) ABSTRACT

A multiple stage tool for use with plunger lift is disclosed. The disclosed device can be removably positioned at a desired position in a well's tubing, thus providing an upper limit for the travel distance of a first plunger. Subsequent well tubing partitions can be established with the introduction of subsequent plungers followed by the disclosed device.

20 Claims, 7 Drawing Sheets

MULTIPLE STAGE TOOL FOR USE WITH PLUNGER LIFT

CROSS REFERENCE APPLICATIONS

This application is a non-provisional application claiming the benefits of provisional application No. 60/895,692 filed Mar. 19, 2007.

FIELD OF ART

The disclosed device relates generally to an apparatus for recovering fluids from hydrocarbon wells, and more specifically to system that can increase production by making use of multiple tubing stages in conjunction with a plunger lift system.

BACKGROUND

In general operation, well liquids are carried out of well tubing by high velocity gas. However, as a well declines, liquids can start to fall back to the bottom of the well. This can result in production decreases because well liquids are not carried to the surface. In addition, the liquid fall back can exert back pressure on the formation, which can "load up" the well. Inflow from the formation is impeded as average flowing bottom hole pressure increases. A plunger lift system can provide a method for unloading fluids in hydrocarbon wells, whereby production can be increased and/or optimized with minimal interruption to production.

In a typical plunger lift system, a plunger can freely travel to the bottom of the well where it may be used to help push liquids to the surface where it is collected. Using the well's own energy for lift, the plunger rises to the surface from the bottom of the well, bringing up liquids. The mechanical interface created by the plunger between any accumulated liquids and gas helps to prevent liquid fallback. Not only does this help in boosting a well's lifting efficiency, the afore-mentioned back pressure can be relieved, which helps to increase inflow from the formation. A plunger can also help keep the well tubing free of paraffin, salt and/or scale build-up.

After the liquids that are carried by the plunger are discharged, and the gas pressure is reduced, the plunger descends by gravity to the bottom of the well for another cycle. When the plunger hits the bottom or contacts fluid in the well, gas pressure that has been allowed to build under the plunger will cause the plunger to rise again with any accumulated fluid.

As described above, a plunger travels to the bottom of the well so it can artificially lift liquids to the surface. The plunger's travel time can be dependent on factors such as geology, gas type, plunger type, etc. The disclosed device can help to minimize plunger travel time and maximize the ability of a plunger lift system to unload a well by incorporating one or more plungers in a system. In addition, the disclosed device can utilize pressure stored in the tubing of a lower stage to lift the fluid and plunger in a higher stage. The disclosed device can be used to partition a well's tubing into discrete and independent sections wherein discrete and independent plungers can operate.

U.S. Pat. No. 7,080,691 to Kegin discloses one such plunger lift tool. Kegin teaches a device that can be removably positioned in oil and gas wells to create multiple stages for use with multiple plungers. Kegin's tool comprises 1) a shaft assembly defining a passageway therein having a top, a spreader cone, and a bottom; 2) a sleeve defining a passageway therein having a top with an expandable bushing and a bottom; 3) a positioning means defining a passageway therein for removably installing said plunger lift tool in said well tubing, said positioning means attached to said bottom of said sleeve; 4) at least one shear pin for selectively holding said shaft assembly in position with said sleeve wherein said at least one shear pin breaks when a downward force F is applied to said top of said shaft assembly allowing said shaft assembly spreader cone to cooperate with said expandable bushing of said sleeve thereby creating a seal between said plunger lift tool and said well tubing; and a retrieval assembly attached to said top of said shaft assembly for removing said tool from said well wherein said retrieval assembly includes a bypass cage with a ball check valve therein. U.S. Pat. No. 7,080,692 to Kegin discloses a method of using such a plunger lift tool.

As disclosed in the above-mentioned references, Kegin's shear pin breaks so the sleeve can slide and the cone can spread to create the seal. After the tool is retrieved from its downhole location, the brass pins must be reset or replaced. Kegin's tool provides for a one-time use. In addition, the pins sheared from the device will fall into the tubing, potentially causing problems for a traveling plunger and other downhole equipment. Other problems encountered by the Kegin device can include damage to the tool itself when the bushing jams in the tubing and tears as it rubs against the tubing and joint collars when the cone fails to disengage the bushing or when the bushing fails to return to its original shape and diameter when the tool is to be removed from the well tubing. Parts of the tool, such as the bushing, must then be fished out of the tubing to prevent problems for a traveling plunger and other downhole equipment. If a device such as Kegin's is improperly set or positioned in a well tubing, the unit must be removed from the tubing and redressed before it can be repositioned (properly or improperly) in the tubing once again. In short, it must be completely removed from the well and redressed before it can be used again.

SUMMARY OF THE DISCLOSURE

By partitioning a well's tubing into discrete and independent sections wherein discrete and independent plungers can operate, the disclosed device can minimize a plunger's travel time by decreasing the distance that any single plunger travels. In addition, the disclosed device can utilize pressure stored in the tubing of a lower stage to lift the fluid and plunger in a higher stage. The disclosed device contemplates a multiple stage tool capable of being used more than one time without having to be redressed. In addition, the disclosed device reduces the likelihood of setbacks caused by tool debris downhole, as in the case of tools using breakable shear pins. If the disclosed device is in some way improperly positioned in a well tubing, it can readily be removed from that position and repositioned at a more suitable location in the well tubing. The disclosed device allows for the repositioning to occur without having to remove the device from the well. The disclosed device also allows for the ready reuse of the device in another well.

A first well tubing partition can be established with the introduction of a first plunger in the well tubing. The disclosed device can be removably positioned at a desired position, thus providing an upper limit for the travel distance of the first plunger. Subsequent well tubing partitions can be established with the introduction of subsequent plungers followed by a partitioning device. The number of partitions and plungers to be implemented may depend on the specifics of any field application. For example, where a tubing is partitioned into four stages, three partitioning devices could be implemented along with four plungers, the bottommost plunger being confinable by the well bottom and a partitioning device and the uppermost plunger being confinable by the well's top and a partitioning device.

In operation, the first plunger travels from the lower end of the well pushing fluid through a distance defined as a first stage, that is, the tubing section confinable by the well bottom and a partitioning device. Accumulated fluid passes through a partitioning device into a subsequent stage where a subsequent plunger acts to push the accumulated fluid to yet another subsequent stage and/or to the surface. In each stage, a plunger is independently allowed to rise under pressure and fall with gravity. In each stage, gas pressure in the tubing of the previous stage causes the plunger and liquid to rise. Use of multiple plungers enables the utilization of the otherwise wasted head gas. As a result, an equivalent quantity of fluid located at a shallower depth can be lifted with less gas and pressure.

For optimization purposes, it is generally desirable to install a plunger in a tubing string such that there is a minimum distance between the plunger's outer surface and the tubing's inner diameter. In some cases, however, a tubing string may have varying inner diameters. Thus, a plunger that is sized to fit within one portion of the tubing may not necessarily be apt for another portion of the tubing. In other words, a plunger having to travel to the bottom of a well may pass through a length of tubing wherein the distance between the plunger outer surface and the tubing's inner diameter is suboptimal. The disclosed device can be used in tubing strings with varying inner diameters.

For example, a tubing partition near a well top could have a wide tubing diameter, where a tubing partition nearer to a well bottom may have a narrow tubing configuration. With the present apparatus, a plunger having a wide outer diameter could be placed in the more shallow tubing partition; a plunger having a narrow outer diameter could be placed in the deeper tubing partition. With the present apparatus, a plunger need not travel to the bottom of well. The use of multiple stages and multiple plungers can help to optimize well production.

In sum, the disclosed device provides for an improved plunger lift tool to be used in conjunction with one or more plungers in a plunger lift system. The tubing partitioning device may be removably positioned at any suitable location within a well tubing string and can be used in tubing of various constructions (collar tubing or joint tubing) and varying diameters. In addition, its durability results in a multiple stage tool capable of being used more than one time without having to be redressed. The reliability of the tubing partitioning device provides for the use of multiple plungers to enable the gas driving an arriving plunger to help to lift fluid in subsequent stages.

These and other advantages of the disclosed device will appear from the following description and/or appended claims, reference being made to the accompanying drawings that form a part of this specification wherein like reference characters designate corresponding parts in the several views.

Before explaining the disclosed embodiments of the disclosed device in detail, it is to be understood that the device is not limited in its application to the details of the particular arrangements shown, since the device is capable of other embodiments. Also, the terminology used herein is for the purpose of description and not of limitation.

DESCRIPTION OF THE DISCLOSED FIGURES

The following description is provided to enable any person skilled in the art to make and use the disclosed apparatus. Various modifications, however, will remain readily apparent to those skilled in the art, since the generic principles of the present apparatus have been defined herein specifically to provide for a tubing partitioning device.

Figure 1A:
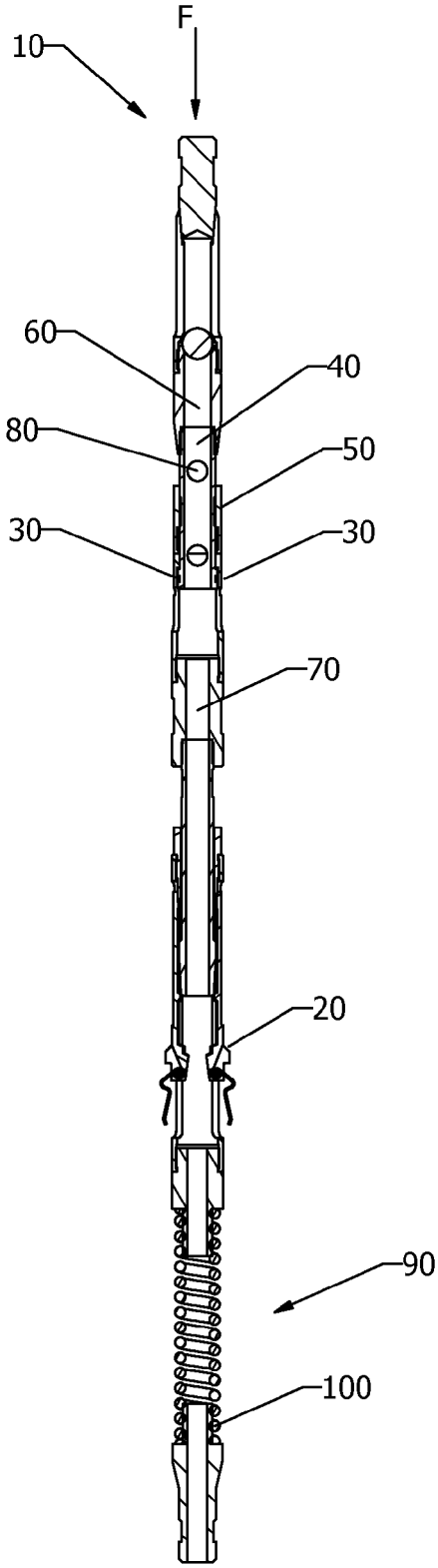
FIG. 1A Prior Art
FIG. 1A is a partial cross sectional illustration of a prior art device shown in an open mode.
Figure 1B:
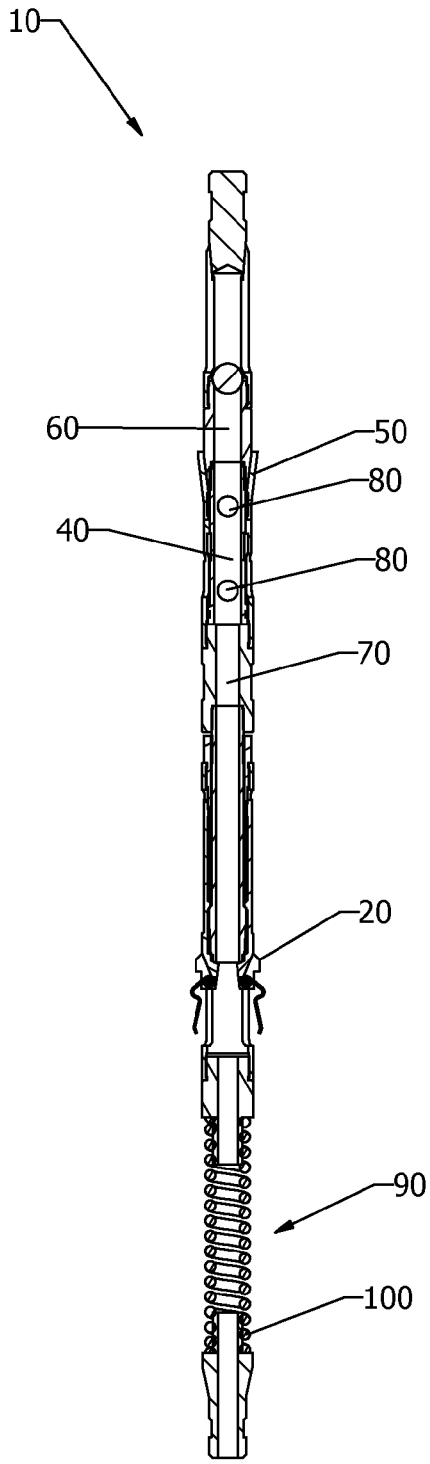
FIG. 1B Prior Art
FIG. 1B is a partial cross sectional illustration of the prior art device of FIG. 1A shown in a closed mode.

FIGS. 1A, 1B show a prior art device in an open and closed mode, respectively. After the tool 10 is located in a well by activating its positioning means 20, a downward force is applied to the tool 10, causing the tool's shearing pins 30 to break which allows the shaft 40 to slide such that bushing 50 engages spreading cone 60 as shaft 40 travels on sleeve assembly 70. Bushing 50 deforms as it engages spreading cone 60 creating a seal with the well tubing (not shown) when the tool 10 is in a closed mode. In the closed mode, bushing 50 serves to enclose fluid egress holes 80. In operation, a traveling plunger (not shown) strikes the free end of a spring assembly 90 located at the lower end of tool 10. Welds 100 hold spring assembly 90 in place on tool 10.

Figure 2A:
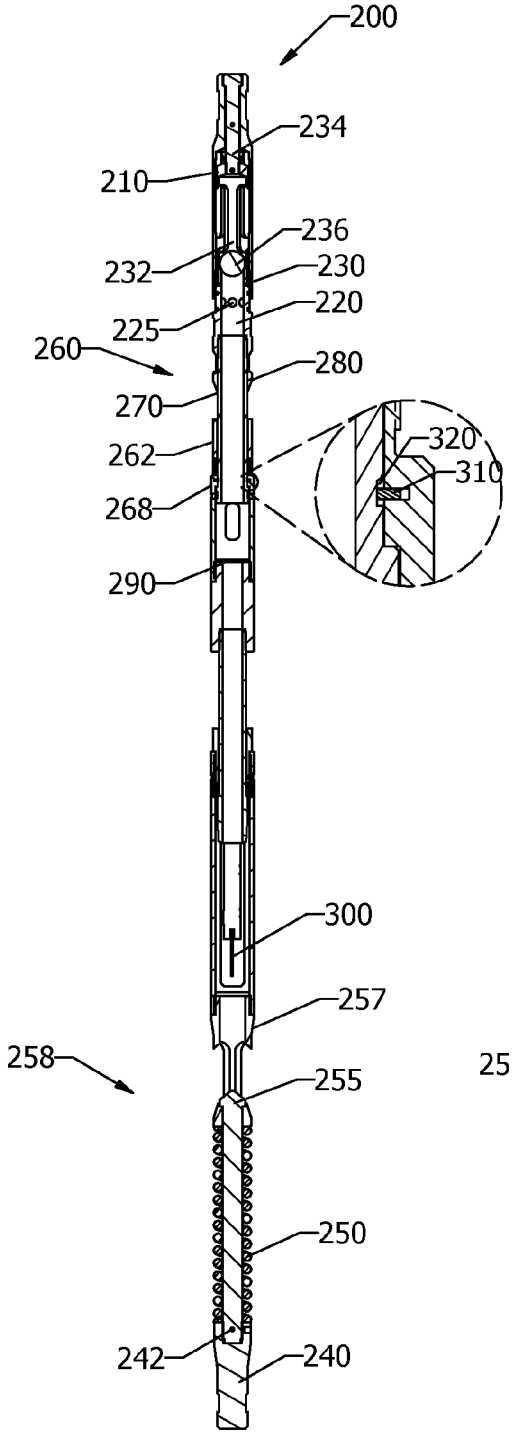
FIG. 2A is a partial cross sectional view of one embodiment of the disclosed well partitioning tool shown in an open mode, wherein a snap ring and groove combination hold a seal cup in place on the shaft assembly until the tool is positioned.
Figure 2B:
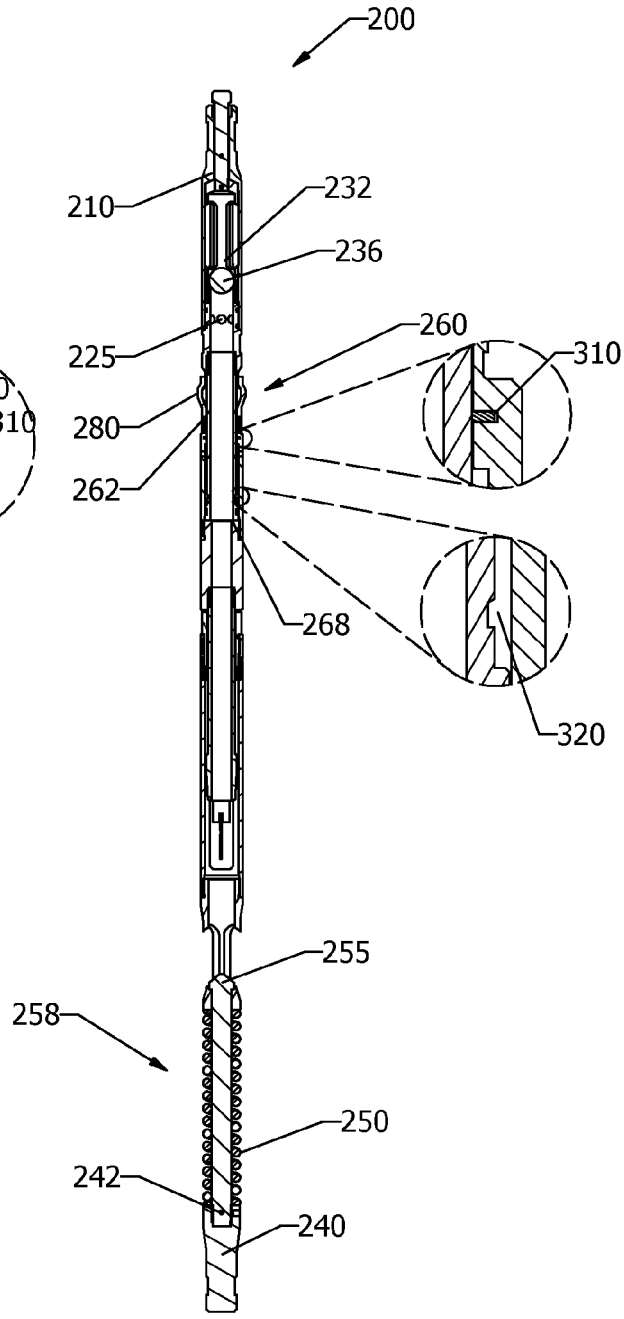
FIG. 2B is a partial cross sectional view of the embodiment of FIG. 2A shown in a closed mode.

As shown in FIGS. 2A, 2B, the present device 200 comprises a tubular tool housing 210 having a flow passage 220. Device 200 can be fitted with an API fishneck design on one or more of its ends. A top end fishneck design can facilitate retrieval of the device from the well tubing and may comprise a top cage fishneck 230, a fishneck insert 232, and a fishneck bypass rod 234. However, other configurations are possible. An impact absorption assembly can also be positioned at or near the top end of the device 200 to dampen a force of impact by a plunger traveling overhead. In some cases, a free-floating bumper spring can be used (not shown). A bottom fishneck design may comprise a spring fishneck 240 connectable to a bumper spring 250 positioned at a lower end of device 200. In the disclosed embodiment, spring fishneck 240 is threaded to spring rod 255. However, other fastening means could be more suitable. Pin 242 is shown as an added support for fishneck 240. Not only can any suitable fastening means be employed, if desired, no fastening means could be used. A free-floating bumper spring could also be used to damp a force of impact by a plunger traveling below. It may also be suitable to use a latch-type spring having fingers to encapsulate an end.

A seal element 260 can help to secure the device in the well tubing. More specifically, seal element 260 can create a flow boundary defining an upper limit for a plunger located below the device and a lower limit for a plunger located above the device when the device is engaged in the tubing. Seal element 260 comprises an expandable housing 262. Although any suitable rubber, synthetic or composite material can be used, the device contemplates that the housing may be constructed of any material that allows for expansion and retraction. In addition, to provide support and/or rigidity, an expandable housing may incorporate a combination of synthetic material and metal. For example, steel or any reinforcing metal/fiber can be radially mounted on an inner surface of the housing or within the synthetic material of the housing itself, if desired.

In this embodiment, expandable housing 262 takes the form of a cup and is fastened to the shaft assembly 270 by means of a threaded seal insert 268. As the device 200 moves into a closed mode, an annular portion 280 of shaft assembly 270 mates with expandable housing 262. An internal stop 290 can be employed to prevent an overpassage of the annular portion 280 within expandable housing 262. Housing 210 serves to enclose fluid egress holes 225. When a desired well depth is reached, the device 200 can be set in the well by activating positioning means 300, shown here as a collar stop. However, any type of positioning means can be employed. For example, a tubing stop could be suitable. A downward force is applied to the device 200, causing the tool's snap ring 310 to disengage a mating groove 320 thereby freeing shaft assembly 270 which comprises annular portion 280 to engage internal stop 290. Expandable housing 262 of seal element 260 contacts the inner diameter of the tubing (not shown) creating a seal when the device 200 is in a closed mode. When device 200 is to be retrieved from the well tubing, known means can be employed. A pulling (upward force) on a retrieval end of device 200 causes annular portion 280 to retract from expandable housing 262, such that snap ring 310 can engage mating groove 320. Expandable housing 262 of seal element 260 retracts from the inner diameter of the tubing and device 200 may be efficiently removed from the well tubing. The design of prior art bushings may not allow for an effective retraction of the bushing away the inner diameter of the tubing even if the spreader cone is disengaged from the bushing.

Consequently, the non-retracted bushing can jam the tool, preventing retrieval from downhole. In addition, the bushing may not readily disengage from the cone because of the cone's frictional grooves. Further, the prior art bushings may need to be secured with additional means so the rubberized material does not slip off the shaft. The expandable housing of the present device provides for a reliable and effective alternative.

A top end fishneck design can facilitate retrieval of device 200 from the well tubing and may comprise a top cage fishneck 230, a fishneck insert 232, and a fishneck bypass rod 234. However, other configurations are possible. Any suitable impact absorption assembly can also be positioned at or near the top end of the device 200 to dampen a force of impact by a plunger traveling overhead. In some cases, a free-floating bumper spring can be used. Fish necks can also be implemented with the various impact absorption assemblies and free-floating bumper springs contemplated.

A ball check valve assembly 236 can direct and equalize flow during a setting of and retrieval of device 200. Ball check valve assembly 236 enables fluid that may have accumulated above housing 210 to flow through when device 200 is retrieved from the well.

During retrieval, device 200 is positioned in an open mode, whereby top cage fish neck 230 retracts to expose fluid egress holes 225. Because the expandable housing of device 200 takes the form of a cup, where the edges are rounded (tucked), accumulated fluid can be "dumped" without being impeded by the sealing element itself. The above-mentioned inefficiencies involved with the failure of the prior art bushing to retract are compounded when accumulated liquid cannot be dumped. As shown in FIG. 1B, bushing 50 serves to enclose fluid egress holes 80. It is desired that in an open mode, the egress holes should be exposed. However, if bushing 50 does not disengage spreading cone 60, whereby egress holes 80 are blocked, the accumulated liquid will be undesirably carried up with the tool during retrieval. In addition, the shape of the prior art bushing lends to fluid retention in and around its edges.

Typically, accumulated or standing fluid will contribute added weight. The disclosed device addresses the difficulty of removal from a well where fluid has accumulated above the tool. Since the egress holes are located between expandable housing 262 and ball check valve assembly 236, fluid can be effectively dumped from above the device.

Figure 3A:
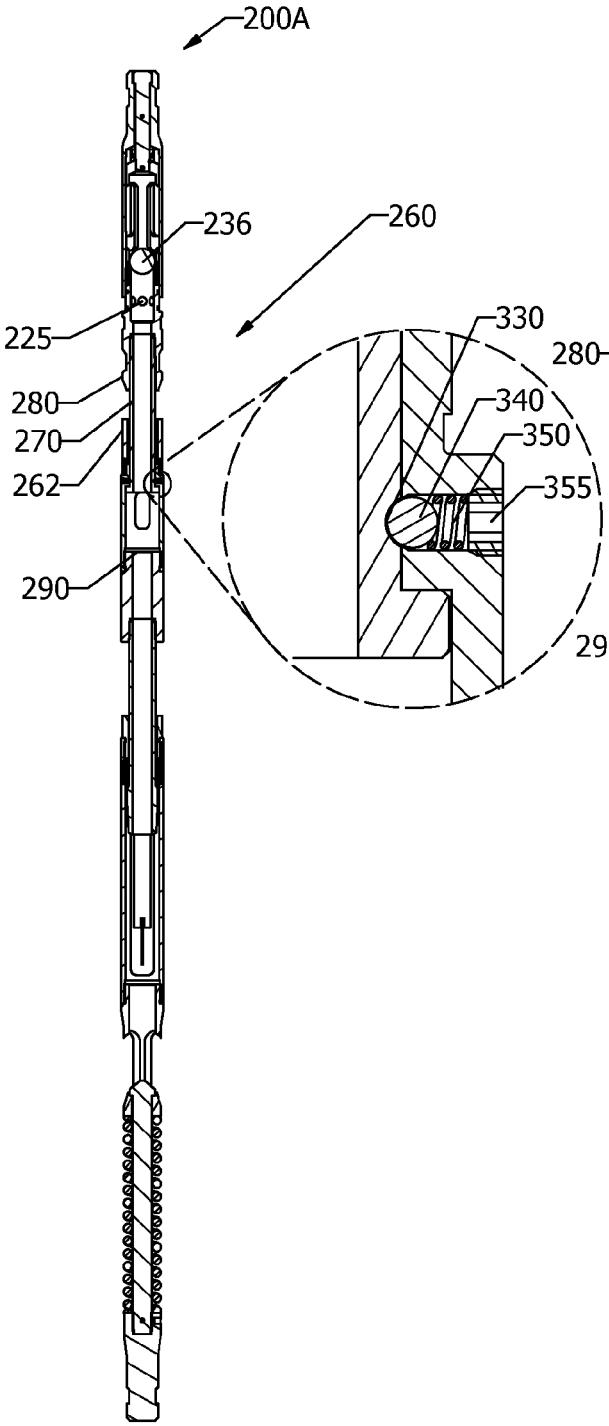
FIG. 3A is a cross sectional view of a closure mechanism comprising a spring and ball, wherein the spring and ball combination are depicted in an open configuration.
Figure 3B:
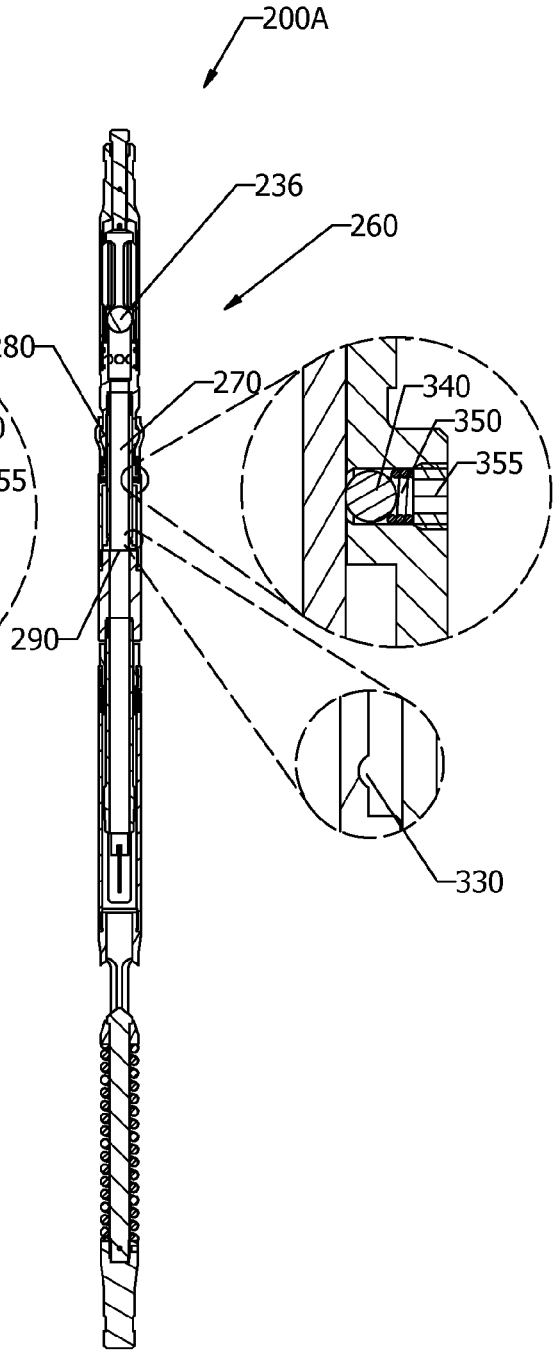
FIG. 3B is a cross sectional view of the closure mechanism of FIG. 3A, wherein the spring and ball combination are depicted in a closed configuration.

In FIGS. 3A, 3B a closure mechanism comprising a spring and ball is shown. The system operates similarly to that of the snap ring and groove combination. When a downward force is applied to the device 200A, the ball 340 compresses a spring 350 mounted to a set screw 355 forcing ball 340 out of grove 330 thereby freeing shaft assembly 270 which comprises annular portion 280 to engage an internal stop 290. Expandable housing 262 of seal element 260 contacts the inner diameter of the tubing as annular portion 280 of shaft assembly 270 mates with expandable housing 262, creating a seal when the device 200A is in a closed mode. Spring 350 retains its compressed configuration until a pulling (upward force) on a retrieval end of device 200A causes ball 340 to travel outbound from spring 350 and thus engage groove 330. The pulling action on a retrieval end of device 200A causes annular portion 280 of shaft assembly 270 to retreat from expandable housing 262. As expandable housing 262 of seal element 260 retracts from the inner diameter of the tubing, device 200A may be efficiently removed from the well tubing.

Although closure means such as a snap ring and groove combination and ball lock and spring combinations are described herein, various other configurations are possible such that they enable the tool to be used a plurality of times without redress.

Figure 4A:
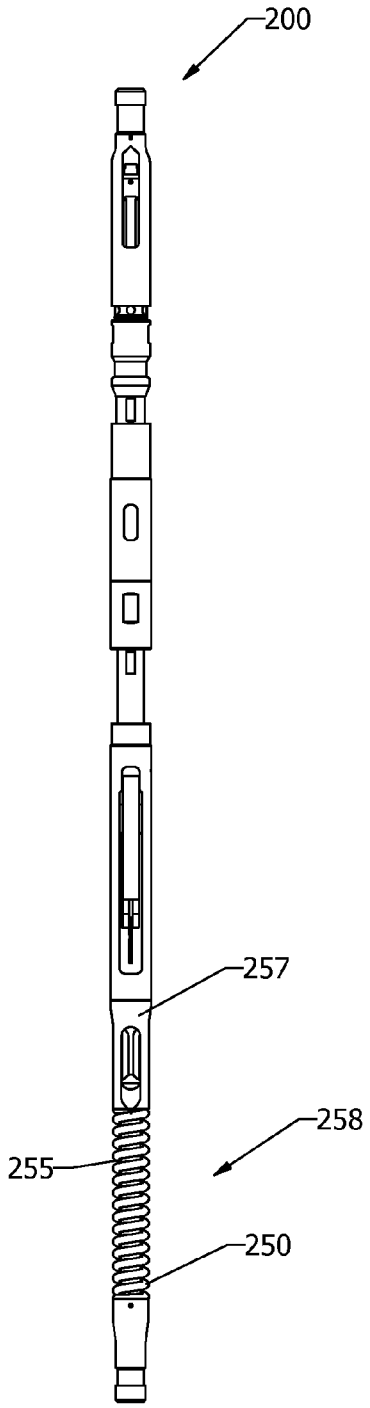
FIG. 4A is a side view of one embodiment of the disclosed well partitioning tool shown in an open mode, wherein a snap ring and groove combination hold a seal cup in place on the shaft assembly until the tool is positioned.
Figure 4B:
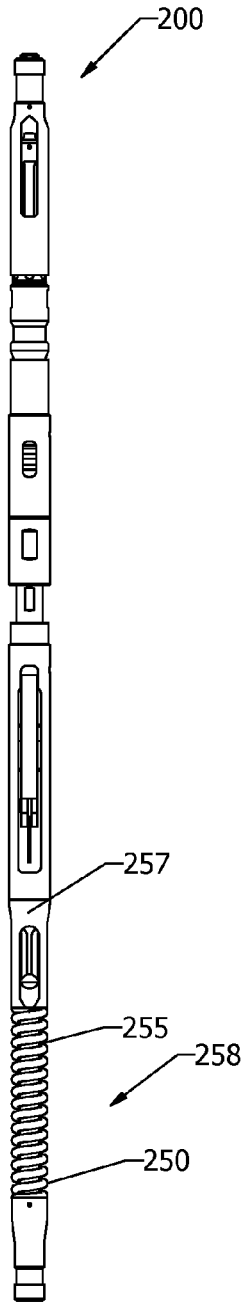
FIG. 4B is a side view of the embodiment shown in FIG. 4A in a partially closed mode.
Figure 4C:
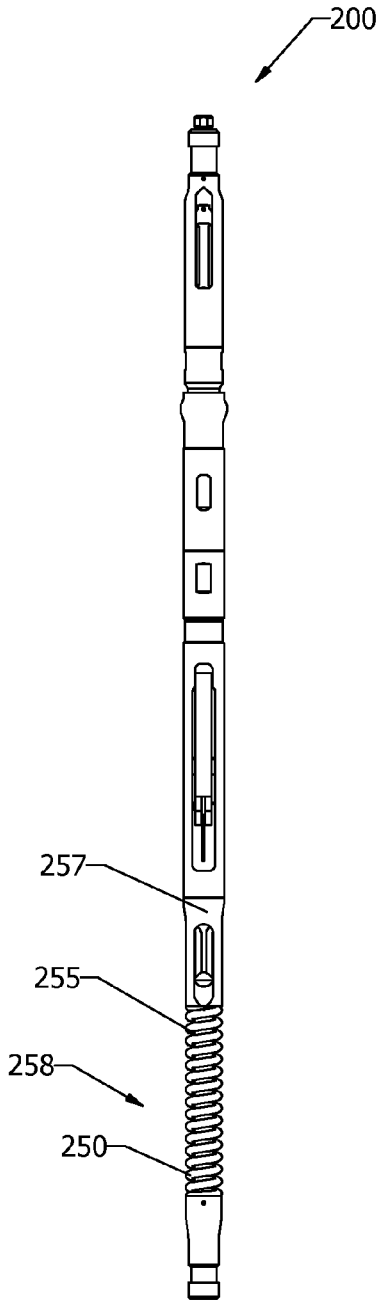
FIG. 4C is a side view of the embodiment shown in FIGS. 4A, 4B in a closed mode.

FIGS. 4A, 4B, 4C illustrate the disclosed well partitioning tool in an open mode, a partially closed mode, and a closed mode respectively. In operation, a traveling plunger (see FIG. 5) positioned below device 200 strikes the free end of a spring assembly 258 located at a lower end of device 200. Spring rod 255 provides for a reinforced bumper spring 250. Among other things, vibration and impact forces may affect the prior art tool, often causing fatigue, deformation, and ultimately failure of the prior art spring assembly 90. In addition, the weld 100 which holds spring assembly 90 in place on tool 10 is apt to break. These limitations can result in a tool that provides for a one-time use before it must be redressed in some way. Reinforced bumper spring 250 renders a durability to device 200. In addition, spring assembly 258 comprises a spring end cage 257 to which bumper spring 250 can be mounted. Spring assembly 258 is located at a lower end of device 200. The disclosed tubing partitioning tool provides for a multiple stage tool capable of being used more than one time without having to be redressed.

Of course, an operator may choose to redress one or more components of the unit after every use, after every third use, after a year of use, or even after ten years of use, whichever situation is applicable, depending on personal preferences, standard operating procedures, maintenance requirements, etc. The disclosed device provides an operator with flexibility in not having to redress the unit each time before it can be used again.

Figure 5:
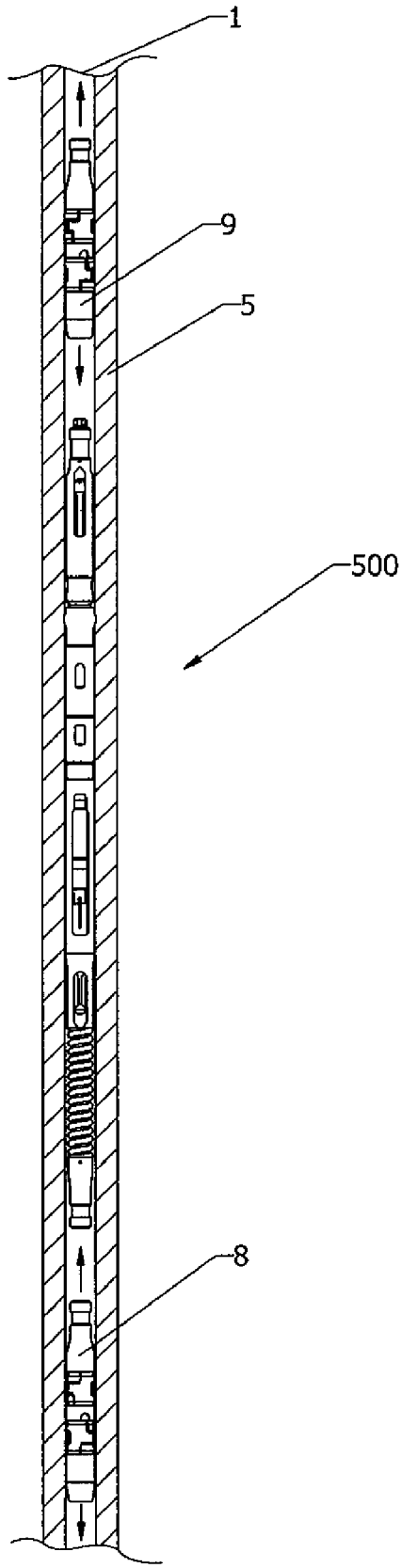
FIG. 5 is an illustration of a plunger lift system comprising multiple tubing partition devices in conjunction with multiple plungers.

FIG. 5 generally shows device 500 located in well 1 tubing 5, whereby two stages are formed, for example. As stated above, the tubing partitioning device can be used to provide any number of stages as practicable by the industry. The deeper stage defines an area of travel for a plunger 8. The shallower stage defines an area of travel for a plunger 9. In operation, plunger 8 may travel to a depth where it may be limited by, e.g., the bottom of well, a tubing partitioning device, etc. As it rises, carrying accumulated fluids and traveling through a distance defined as a stage, driven by a downhole pressure, plunger 8 can approach a lower end of device 500. At the interface, accumulated fluid passes through device 500 and into the shallower stage serviced by plunger 9. Ball check valve assembly 236 (see FIGS. 2A, 2B, 3A, 3C) in device 500 can direct and equalize flow of accumulated fluid as the fluid rises to the surface. Accumulated fluid is then carried up by plunger 9, and so on. Use of multiple plungers enables the disclosed device to take advantage of pressure stored in the tubing of a lower stage to lift the fluid/plunger in a higher stage.

As stated above, a tubing string may have varying inner diameters, as in the case of a tapered string. Thus, a plunger that is sized to fit within one portion of the tubing may not necessarily be apt for another portion of the tubing. The disclosed device can be used in tubing strings with varying inner diameters. To use the illustration of FIG. 5, plunger 8 could comprise a diameter smaller in size than that of plunger 9 as larger diameter tubing is generally located at shallower depths. Thus, as the depth increases, the tubing diameter decreases. Alternately, plunger 8 could comprise a diameter larger in size than that of plunger 9 if tubing diameter increased with depth.

Figure 6A:
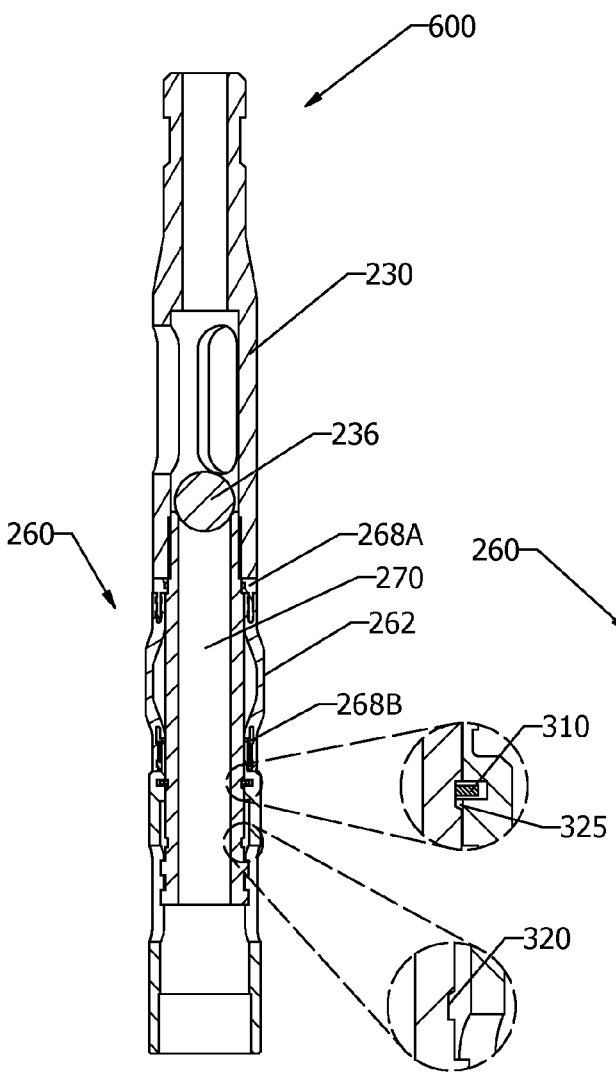
FIGS. 6A, 6B show an alternate embodiment of the seal assembly.
Figure 6B:
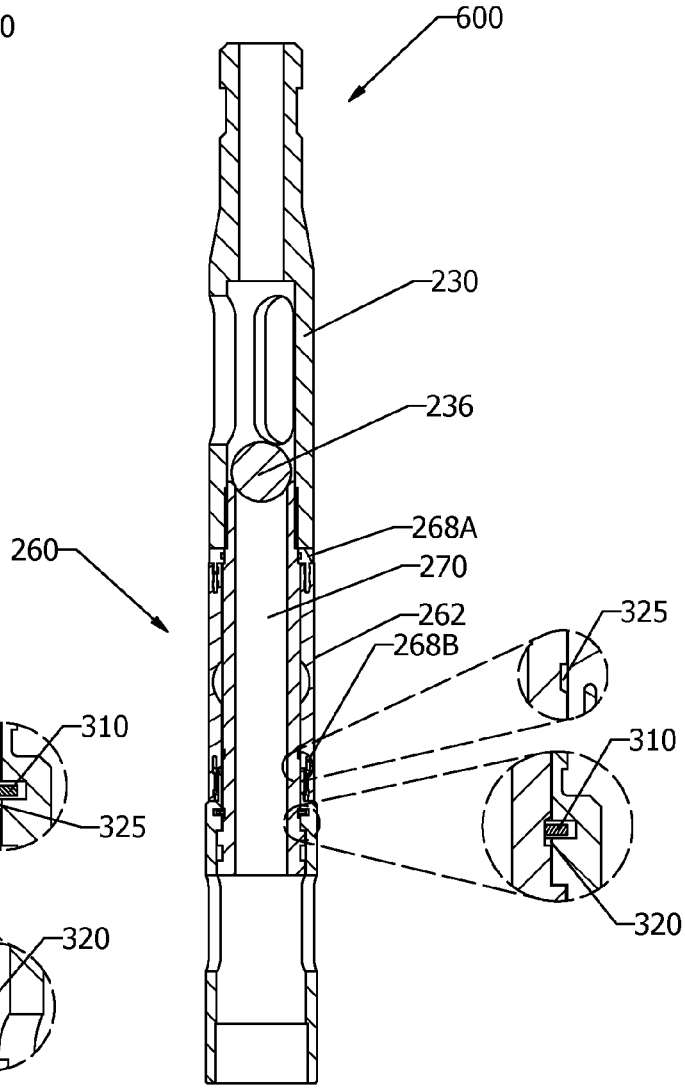
Figure 7A:
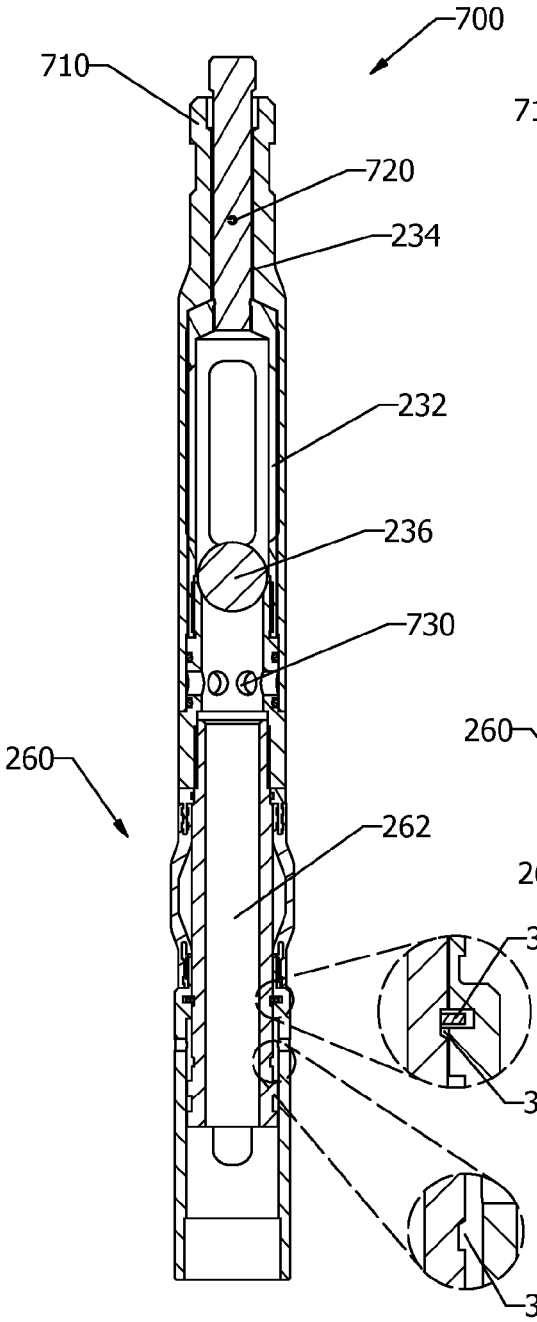
FIGS. 7A, 7B show an alternate embodiment of the seal assembly in conjunction with a fluid bypass mechanism.

FIGS. 6A, 6B, 7A, 7A depict alternate embodiments of the seal assembly. As shown in FIG. 6A, the tool's snap ring 310 can be disengaged from a first mating groove 320 when a downward force is applied to the device 600. As snap ring 310 moves to engage a second mating groove 325, expandable housing 262 of seal element 260 contacts the inner diameter of the tubing (not shown) creating a seal when the device 600 is in a closed mode. In this embodiment, expandable housing 262 is fastened to the shaft assembly 270 at an upper and lower end of the housing by means of threaded seal insert 268A, 268B, respectively. A pulling (upward force) on a retrieval end of device 600 causes snap ring 310 to disengage mating groove 325. As snap ring 310 moves to engage mating groove 320, causing expandable housing 262 of seal element 260 to retract from the inner diameter of the tubing, device 600 may be efficiently removed from the well tubing. Expandable housing 262 retracts from the inner diameter of the tubing allowing accumulated fluid to be dumped from the space created between the tool and the tubing.

Figure 7B:
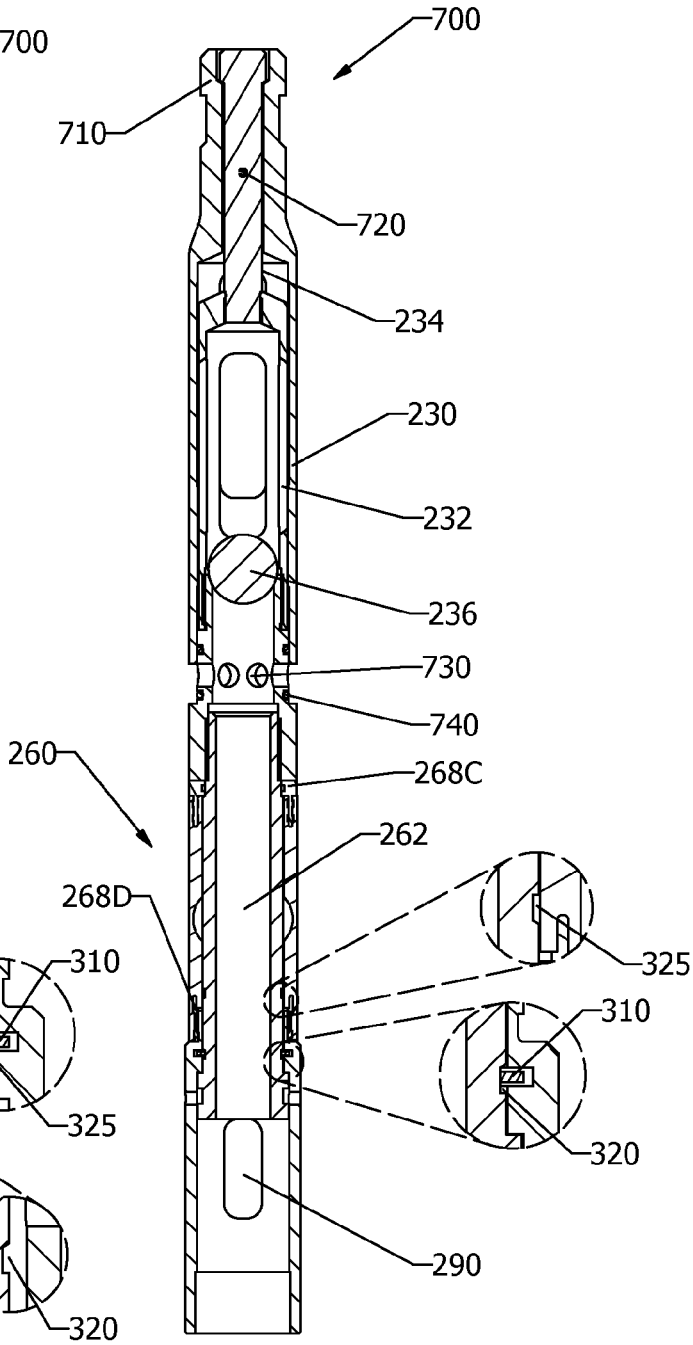

The embodiment of FIG. 7 operates much in the same manner as that of FIG. 6, wherein a series of snap rings and mating grooves cause expandable housing 262 of seal element 260 to contact and retract from the inner diameter of the tubing. A top end fishneck design can facilitate retrieval of the device from the well tubing and may comprise a top cage fishneck 230, a fishneck insert 232, and a fishneck bypass rod 234. However, other configurations are possible.

A ball check valve assembly 236 can direct and equalize flow during a setting of and retrieval of device 700. Ball check valve assembly 236 enables fluid that may have accumulated above housing 710 to flow through or dump when device 700 is retrieved from the well.

A pulling (upward force) on a retrieval end of device 700 causes snap ring 310 to disengage mating groove 325. As snap ring 310 moves to engage mating groove 320, causing expandable housing 262 of seal element 260 to retract from the inner diameter of the tubing, device 700 may be efficiently removed from the well tubing. In embodiments that employ a roll pin, the pulling action could also cause a shearing of roll pin 720 which could expose a series of egress holes 730 from which accumulated fluid can be dumped. An O-ring 740 can be used to provide a seal. As stated above, various types of closure mechanisms can be employed depending on the particular application. For example, it is contemplated that a snap ring could be employed instead of a roll pin if desired.

The present apparatus contemplates a multiple stage tool capable of being used more than one time.

Although the disclosed device and method have been described with reference to disclosed embodiments, numerous modifications and variations can be made and still the result will come within the scope of the disclosure. No limitation with respect to the specific embodiments disclosed herein is intended or should be inferred.

We claim:

1. A staging tool capable of use with one or more plungers in a plunger lift system, said tool comprising:

an elongate body having an upper end, a lower end, and a seal element capable of abutting an inner surface of a well tubing;

said seal element capable of creating a flow boundary defining an upper limit for a plunger locatable below said lower end and a lower limit for a plunger locatable above said upper end when said body is engaged in said tubing;

said body capable of passing liquids carried by said plunger locatable below said lower end across said flow boundary, thereby allowing liquids to be carried by said plunger locatable above said upper end;

said seal element further comprising an expandable housing mateable with an annular portion of a shaft when a downward force is applied to said upper end, said downward force causing a downward travel of said shaft and a disengaging of a closure mechanism; and wherein said annular portion of said shaft retracts from said expandable housing when a pulling force is applied to said upper end, said pulling force causing an upward travel of said shaft and an engaging of said closure mechanism, thereby allowing said body to be extracted from said tubing for ready reuse.

2. The tool of claim 1, wherein said body further comprises a check valve assembly to direct and equalize flow of liquids passing across said flow boundary.

3. The tool of claim 2, wherein said check valve assembly enables liquid accumulated thereabove to dump through said body when said body is extracted from said tubing.

4. The tool of claim 1, wherein said expandable housing returns to its original shape and diameter when said annular portion of said shaft retracts therefrom.

5. The tool of claim 1, wherein said expandable housing further comprises a cup fastenable to said shaft by means of a threaded seal insert.

6. The tool of claim 1, wherein said expandable housing further comprises an internal stop to prevent an overpassage therein of said annular portion.

7. The tool of claim 1, wherein said closure mechanism further comprises a snap ring mateable with a groove.

8. The tool of claim 1, wherein said closure mechanism further comprises a spring and ball.

9. The tool of claim 1, wherein said body is removably securable in said well tubing.

10. The tool of claim 1, wherein the plunger above the upper end and the plunger below the lower end rise substantially simultaneously.

11. The tool of claim 10, wherein the plunger above the upper end lifts liquid brought to the flow boundary after its return trip to the flow boundary.

12. A tubing partitioning device comprising:

an elongate body having an upper end, a lower end, and a shaft assembly;

said shaft assembly capable of being freed from a locked position when a downward force is applied to said upper end, said downward force causing a downward travel of said shaft assembly whereby an expandable housing mates with an annular portion of said shaft assembly to form a mated section;

said mated section having an outer surface capable of contacting an inner diameter of a well tubing and forming a flow boundary, thereby confining a plunger locatable below said lower end;

said plunger capable of carrying liquids to said flow boundary, whereby said liquids pass through said body to be carried by a plunger locatable above said upper end; and wherein said body can be retrieved from said tubing for ready reuse when a pulling force is applied to said upper end, said pulling force causing said mated section to separate when said annular portion retreats from said expandable housing and said outer surface disengages said inner diameter, said pulling force further causing said shaft assembly to progress to its locked position.

13. The device of claim 12, wherein the second plunger uses pressure stored in the tubing of a lower stage to lift locatable above the upper end and the plunger locatable below the lower end rise substantially simultaneously.

14. A method of lifting fluid in a gas well, said method comprising:

positioning a first plunger in a well tubing, said first plunger capable of lifting liquids thereover;

removably positioning a partitioning device within said well tubing, said partitioning device having an upper and a lower end, said lower end providing an upper limit for a travel distance of said first plunger and further defining a stage;

positioning a second plunger in said well tubing, said second plunger capable of lifting liquids thereover;

enabling said first plunger to rise under pressure to lift liquids to said upper limit, whereby said liquids pass through said partitioning device to said upper end;

enabling said second plunger to rise under pressure to lift said liquids to at least one subsequent stage or the surface; and wherein said step of removably positioning said partitioning device further comprises providing a device capable of ready reuse without having to be redressed.

15. The method of claim 14 further comprising the step of removably repositioning said partitioning device in an alternate well tubing location.

16. The method of claim 14 further comprising the step of removing said partitioning device from said well tubing.

17. The method of claim 14, wherein the first and second plungers rise substantially simultaneously.

18. A method of lifting fluid in a gas well, said method comprising:

positioning one or more plungers in a well tubing, said one or more plungers positioned alternatingly adjacent to one or more removable partitioning devices;

enabling a bottommost plunger to rise under pressure to lift liquids to a lower end of a bottommost partitioning device, whereby said liquids pass through said bottommost partitioning device to an upper end;

enabling a subsequent plunger to rise under pressure to lift said liquids to a lower end of an adjacent partitioning device or to the surface; and wherein the step of positioning said one or more plungers further comprises providing one or more removable partitioning devices capable of ready reuse without having to be redressed.

19. The method of claim 18 further comprising the step of repositioning said one or more partitioning devices in one or more alternate locations in said well tubing.

20. The method of claim 18, wherein the bottommost plunger and the subsequent plunger rise substantially simultaneously.

* * * * *